US010371423B2

(12) United States Patent
Vanden Hogen et al.

(10) Patent No.: US 10,371,423 B2
(45) Date of Patent: Aug. 6, 2019

(54) REFRIGERANT BALANCING IN A MICROCHANNEL COIL

(71) Applicant: TRANE INTERNATIONAL INC., Davidson, NC (US)

(72) Inventors: Samuel J. Vanden Hogen, La Crosse, WI (US); George M. Singh, La Crosse, WI (US); William B. Fox, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 3 days.

(21) Appl. No.: 15/436,305

(22) Filed: Feb. 17, 2017

(65) Prior Publication Data

US 2018/0238597 A1 Aug. 23, 2018

(51) Int. Cl.

| | |
|---|---|
| ***F25B 39/04*** | (2006.01) |
| ***F25B 39/00*** | (2006.01) |
| ***F25B 40/02*** | (2006.01) |
| ***F25B 41/06*** | (2006.01) |
| ***F25B 45/00*** | (2006.01) |

(52) U.S. Cl.

CPC ..... *F25B 39/00* (2013.01); *F25B 39/04* (2013.01); *F25B 40/02* (2013.01); *F25B 41/06* (2013.01); *F25B 45/00* (2013.01); *F25B 2339/044* (2013.01); *F25B 2500/09* (2013.01)

(58) Field of Classification Search

CPC .... F25B 39/00; F25B 41/06; F25B 2339/044; F25B 39/04

See application file for complete search history.

(56) References Cited

U.S. PATENT DOCUMENTS

| | | | | |
|---|---|---|---|---|
| 5,813,249 | A | 9/1998 | Matsuo et al. | |
| 5,927,102 | A * | 7/1999 | Matsuo | F25B 39/04 62/509 |
| 2008/0156014 | A1 * | 7/2008 | Kopko | F25B 39/04 62/314 |

FOREIGN PATENT DOCUMENTS

| | | |
|---|---|---|
| DE | 10350192 | 5/2004 |

OTHER PUBLICATIONS

Extended European Search Report; European Patent Application No. 18155653.1; dated Jul. 19, 2018 (8 pages).

* cited by examiner

*Primary Examiner* — Ana M Vazquez
(74) *Attorney, Agent, or Firm* — Hamre, Schumann, Mueller & Larson, P.C.

(57) ABSTRACT

A refrigeration unit and methods of operating a refrigeration unit for an HVACR system are disclosed. The refrigeration unit includes a refrigerant circuit, including a compressor, a condenser, an expansion device, and an evaporator fluidly connected. The condenser includes a condenser portion and a subcooler portion. A single receiver tank is fluidly connected to an output of the condenser portion and an input of the subcooler portion. A restrictor is fluidly connected to the receiver tank. The restrictor can induce a pressure drop in a working fluid flowing from the subcooler portion.

12 Claims, 6 Drawing Sheets

REFRIGERANT BALANCING IN A MICROCHANNEL COIL

FIELD

This disclosure relates generally to a heating, ventilation, air conditioning, and refrigeration (HVACR) system. More specifically, the disclosure relates to flow control of a refrigerant in a refrigerant circuit of an HVACR system.

BACKGROUND

An HVACR system can include a refrigerant circuit having a compressor, a condenser, an expansion device, and an evaporator fluidly connected. The condenser can include a subcooler portion. A plurality of condensers can be connected in parallel in the refrigerant circuit.

SUMMARY

This disclosure relates generally to a heating, ventilation, air conditioning, and refrigeration (HVACR) system. More specifically, the disclosure relates to flow control of a refrigerant in a refrigerant circuit of an HVACR system.

A refrigeration unit for an HVACR system is disclosed. The refrigeration unit includes a refrigerant circuit, including a compressor, a condenser, an expansion device, and an evaporator fluidly connected. The condenser includes a condenser portion and a subcooler portion. A single receiver tank is fluidly connected to an output of the condenser portion and an input of the subcooler portion. A restrictor is fluidly connected to the subcooler portion. The restrictor can induce a pressure drop in a working fluid flowing from the subcooler portion.

A refrigerant circuit is disclosed. The refrigerant circuit includes a compressor, a condenser, an expansion device, and an evaporator fluidly connected. The condenser includes a condenser portion and a subcooler portion. A single receiver tank is fluidly connected to an output of the condenser portion and an input of the subcooler portion. A restrictor is fluidly connected to the subcooler portion, the restrictor for inducing a pressure drop in a working fluid flowing from the subcooler portion.

A method of operating a refrigeration unit is disclosed. The method includes compressing a working fluid by a compressor in a refrigerant circuit. The compressed working fluid is output to a condenser in the refrigerant circuit, the condenser including a condenser portion and a subcooler portion. The compressed working fluid is received by the condenser portion. The working fluid is condensed in the condenser portion and the condensed working fluid is output to a receiver tank disposed fluidly between the condenser portion and the subcooler portion. A pressure of the working fluid output from the subcooler portion is reduced after the working fluid is output from the subcooler portion.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to a heating, ventilation, air conditioning, and refrigeration (HVACR) system. More specifically, the disclosure relates to flow control of a refrigerant in a refrigerant circuit of an HVACR system.

Some refrigeration units can include a plurality of microchannel condensers fluidly connected in parallel. In an embodiment, a receiver tank can be included on one of the plurality of microchannel condensers. Including the receiver tank may be desirable to, for example, reduce an amount of hardware for the refrigeration unit, reduce a cost of the unit, or the like. Placing the receiver tank on one of the plurality of condenser coils can, for example, result in an imbalance of refrigerant between the plurality of condenser coils. The imbalance of refrigerant can cause refrigerant exiting the condenser coils to be at different temperatures depending upon the particular condenser coil. This can in turn result in an underperforming refrigeration unit, unpredictable or irregular operation of the refrigeration unit, or the like.

A refrigeration unit, as used in this specification, includes a machine having a refrigerant circuit and that can exchange heat with a process fluid (e.g., water, air, glycol, or the like) via a heat transfer relationship with a working fluid of the refrigerant circuit. A refrigeration unit that uses a liquid process fluid (e.g., water, glycol, or the like) may be referred to as a chiller, liquid chiller, or the like. A refrigeration unit that uses a gaseous process fluid (e.g., air or the like) may be referred to as an air conditioner, heat pump, or the like.

An air-cooled chiller, as used in this specification, includes a chiller in which a process fluid for exchanging heat with a condenser in the refrigerant circuit is air. That is, in an air-cooled chiller, the condenser may exchange heat with air, and an evaporator of the refrigerant circuit can exchange heat with a process fluid that includes, for example, water, glycol, combinations thereof, or the like.

A microchannel condenser, as used in this specification, includes a heat exchanger having a plurality of flat tubes with fins located between the flat tubes extending between a plurality of headers.

Aspects described herein can be applied to, for example, split systems, unitary equipment, rooftop equipment, or the like.

Figure 1:
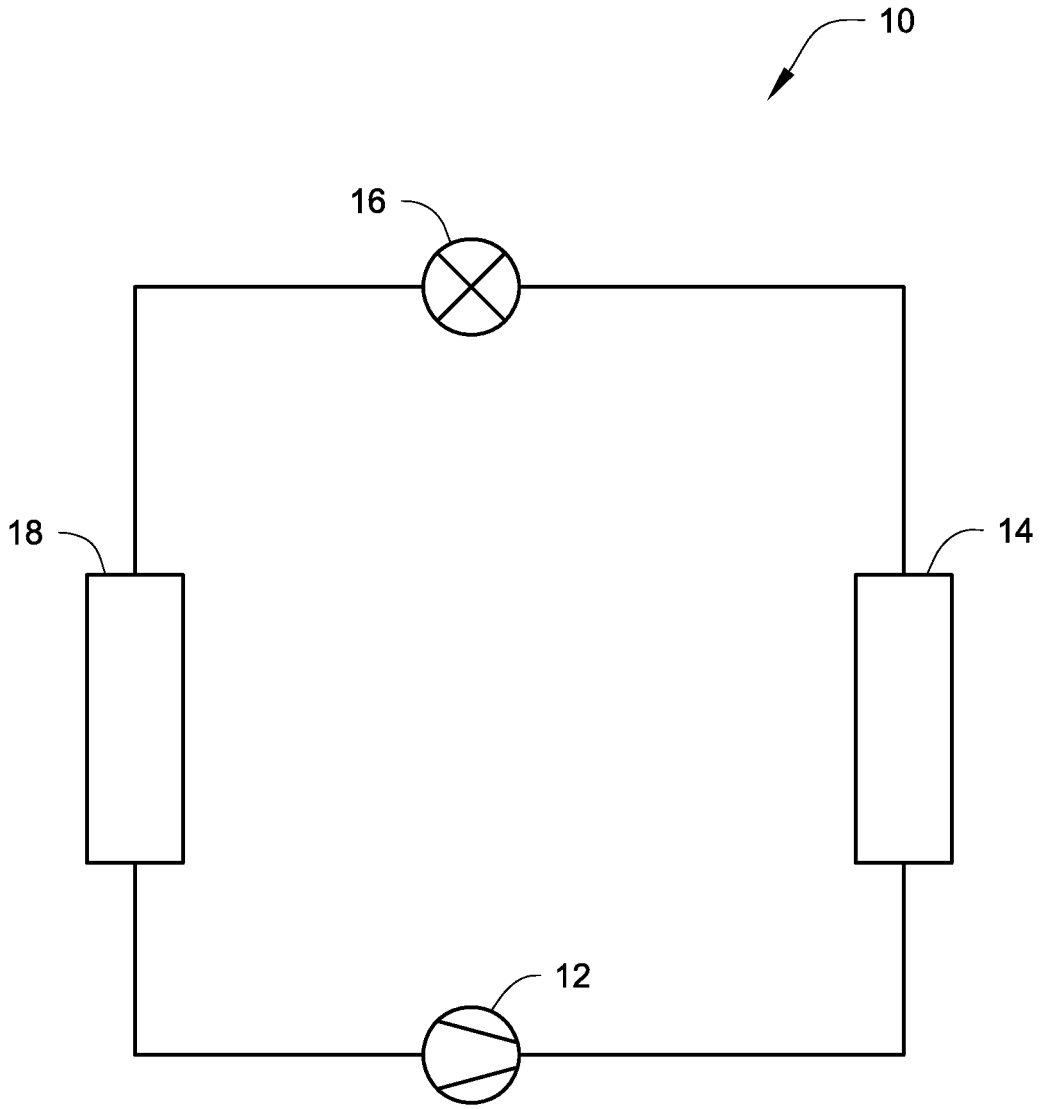
FIG. 1 is a schematic diagram of a refrigerant circuit, according to an embodiment.

FIG. 1 is a schematic diagram of a refrigerant circuit 10, according to an embodiment. The refrigerant circuit 10 generally includes a compressor 12, a condenser 14, an expansion device 16, and an evaporator 18. The compressor 12 can be, for example, a scroll compressor. It will be appreciated that the compressor can be other types of compressors such as, but not limited to, a screw compressor, reciprocating compressor, centrifugal compressor, or the like. The refrigerant circuit 10 is an example and can be modified to include additional components. For example, in an embodiment, the refrigerant circuit 10 can include other components such as, but not limited to, an economizer heat exchanger, one or more flow control devices, a receiver tank, a dryer, a suction-liquid heat exchanger, or the like.

The refrigerant circuit 10 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 12, condenser 14, expansion device 16, and evaporator 18 are fluidly connected. In an embodiment, the refrigerant circuit 10 can be configured to be a cooling system (e.g., an air conditioning system) capable of operating in a cooling mode. In an embodiment, the refrigerant circuit 10 can be configured to be a heat pump system that can operate in both a cooling mode and a heating/defrost mode.

The refrigerant circuit 10 can operate according to generally known principles. The refrigerant circuit 10 can be configured to heat or cool a liquid process fluid (e.g., a heat transfer fluid or medium such as, but not limited to, water, glycol, or the like), in which case the refrigerant circuit 10 may be generally representative of a liquid chiller system. The refrigerant circuit 10 can alternatively be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. In an embodiment, the condenser 14 can include a plurality of condenser coils connected in parallel. In an embodiment, the condenser 14 can include a condenser portion and a subcooler portion that are fluidly connected. The working fluid flows through the condenser 14 and rejects heat to a process fluid (e.g., air or the like), thereby cooling the working fluid. The cooled working fluid, which is now in a liquid form, flows to the expansion device 16. In an embodiment in which the condenser 14 includes a subcooler portion, the liquid working fluid can flow through the subcooler portion prior to flowing to the expansion device 16. In the subcooler portion, the working fluid may be further subcooled. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from a process fluid (e.g., water, glycol, air, or the like) heating the working fluid, and converting it to a gaseous form. The gaseous working fluid then returns to the compressor 12. The above-described process continues while the refrigerant circuit is operating, for example, in a cooling mode (e.g., while the compressor 12 is enabled).

Figure 2:
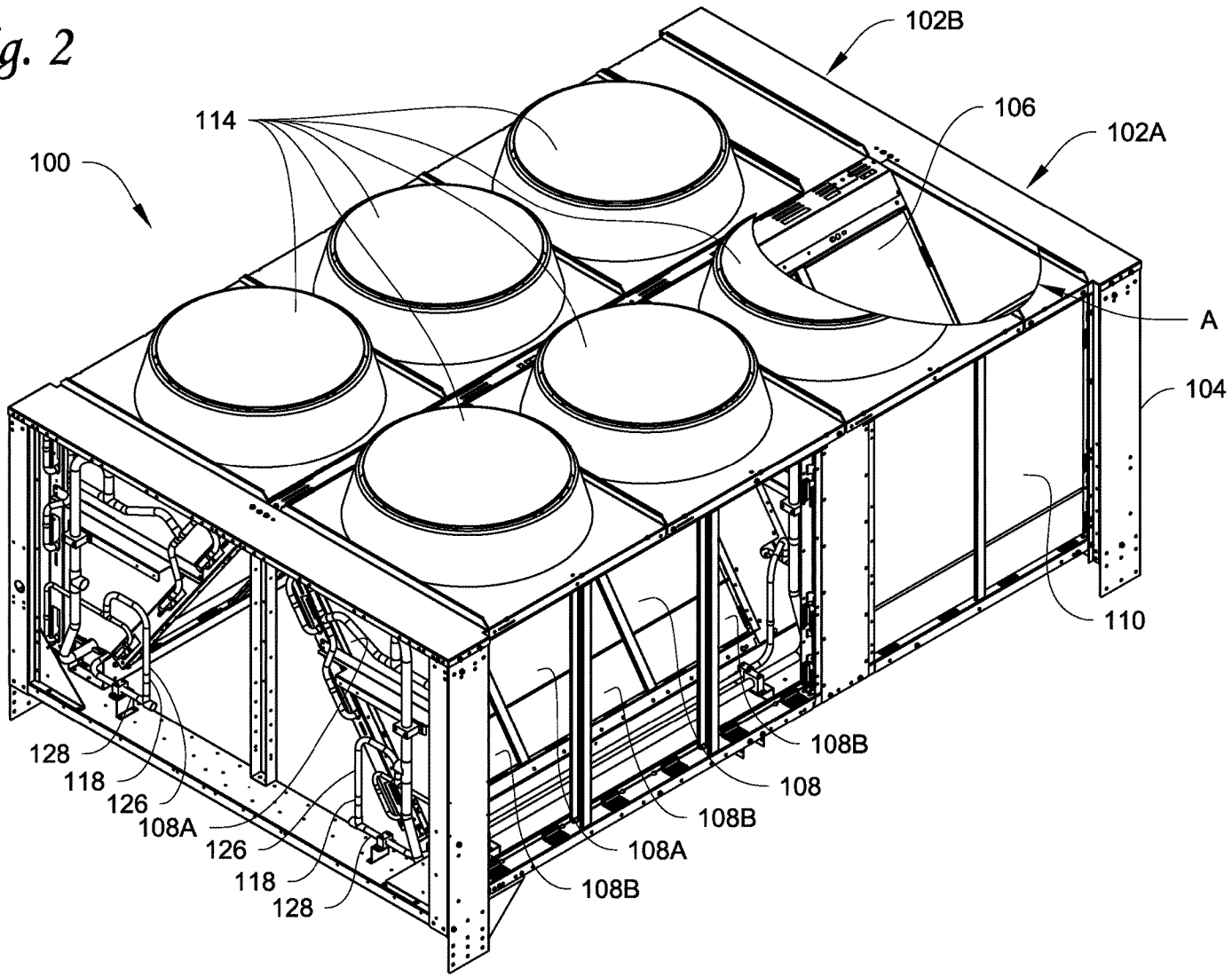
FIG. 2 is a front perspective view of a refrigeration unit for an HVACR system, according to an embodiment.
Figure 3:
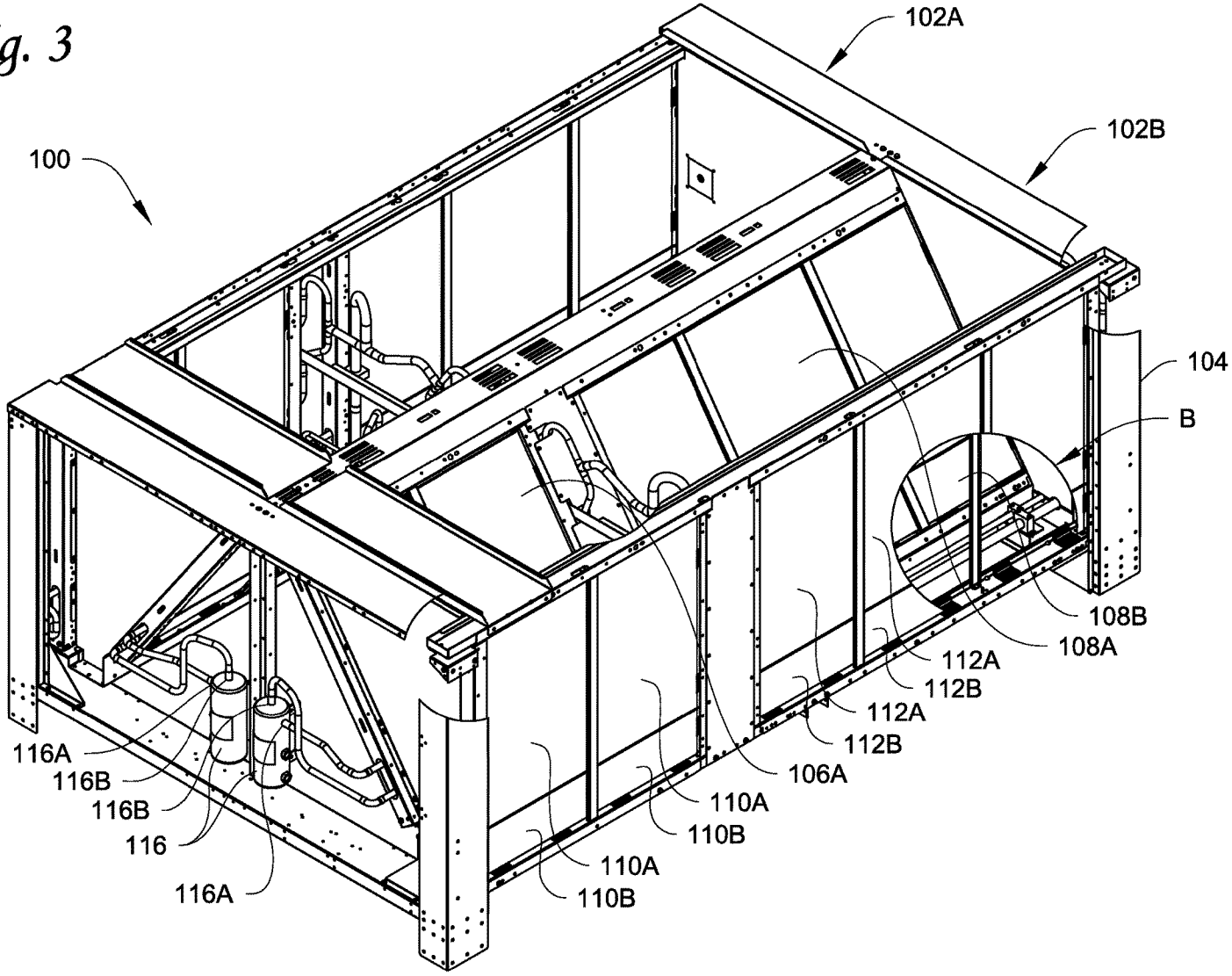
FIG. 3 is a rear perspective view of the refrigeration unit in FIG. 2 for an HVACR system, according to an embodiment.
Figure 4:
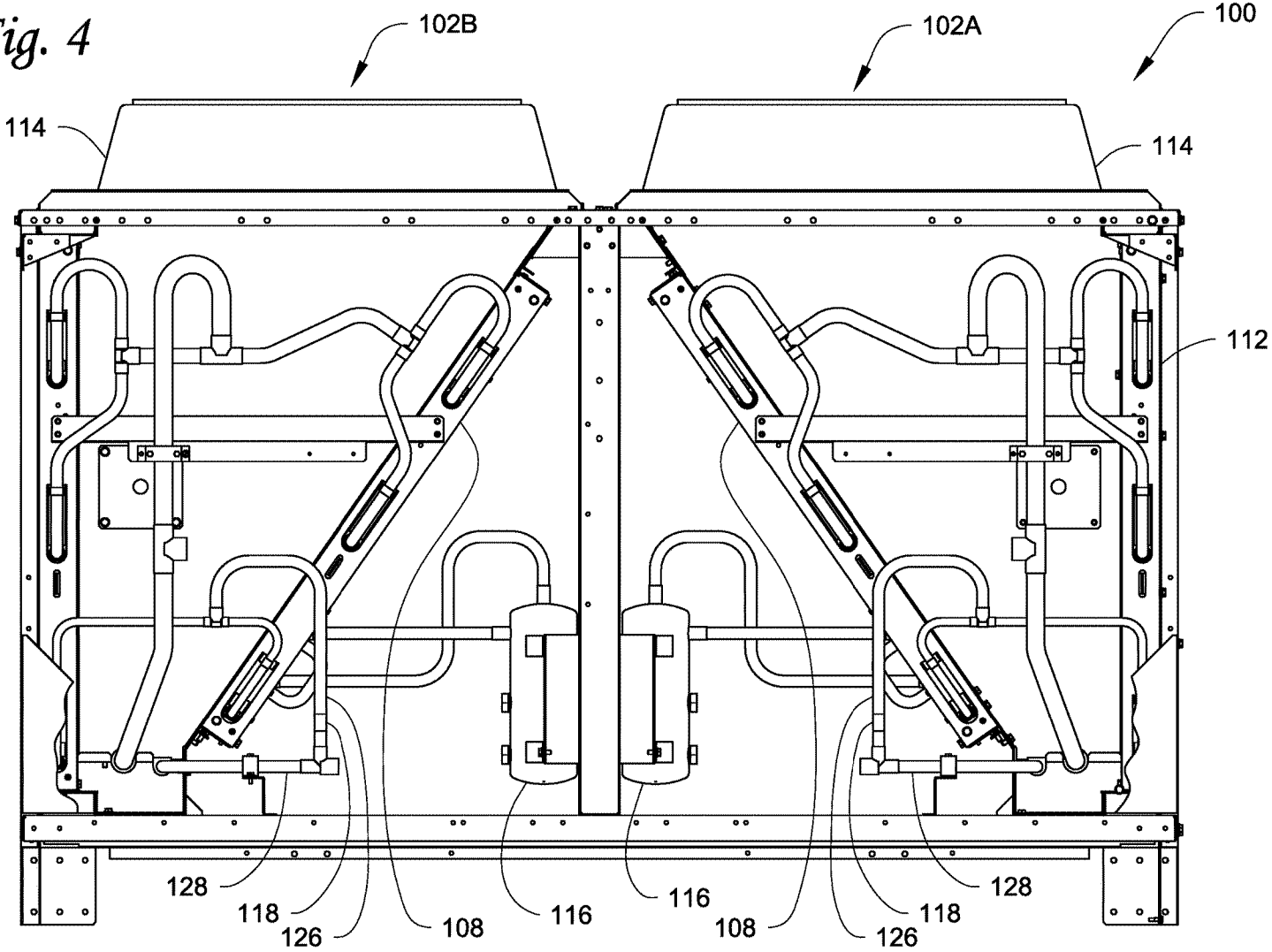
FIG. 4 is a sectional view of the refrigeration unit in FIGS. 2 and 3 for an HVACR system, according to an embodiment.

FIGS. 2 and 3 are perspective views of a refrigeration unit 100, according to an embodiment. FIG. 2 shows a perspective view of a first end of the refrigeration unit 100 and FIG. 3 shows a perspective view of a second end, opposite the first end, of the refrigeration unit 100. A portion A of FIG. 2 is removed to show a view into the refrigeration unit 100. A portion B of FIG. 3 is removed to show a view into the refrigeration unit 100. FIG. 4 is an end view of a front end of the refrigeration unit 100. FIGS. 2-4 will be generally described, with some reference made to specific figures throughout.

The refrigeration unit 100 can, for example, be an air-cooled chiller in an embodiment. The refrigeration unit 100 can include a refrigerant circuit such as the refrigerant circuit 10 shown and described in accordance with FIG. 1 above. In an embodiment, the refrigeration unit 100 can operate the refrigerant circuit 10 to exchange heat with a process fluid (e.g., water, glycol, combinations thereof, or the like). The process fluid can, for example, be provided to one or more pieces of HVACR equipment within a building to control an environmental variable (e.g., temperature, humidity, or the like) in a conditioned space (e.g., one or more rooms) of the building.

In the illustrated embodiment, the refrigeration unit 100 includes a first circuit 102A and a second circuit 102B. The circuits 102A, 102B can be the same, according to an embodiment. In an embodiment, the circuits 102A, 102B can be different. It will be appreciated that the number of circuits 102A, 102B included in the refrigeration unit 100 may be determined by, for example, a capacity of the refrigeration unit 100. That is, in an embodiment, the refrigeration unit 100 may include a single circuit 102A or 102B, while another embodiment can include a plurality of refrigerant circuits 102A and 102B, or more. For simplicity of the description that follows, the circuits will generally be referred to as the circuit 102. It will be appreciated that the description is applicable to the circuit 102A and the circuit 102B.

The refrigeration unit 100 includes a frame 104. The frame 104 provides a structure in which the circuit 102 and its corresponding components may be located. The circuit 102 generally includes a refrigerant circuit such as the refrigerant circuit 10 in FIG. 1. In the circuit 102, a plurality of condensers 106, 108, 110, and 112 are connected in parallel.

The condensers 106-112 can be microchannel condensers. It will be appreciated that embodiments described in this specification may be applicable to condensers other than microchannel condensers, although the benefits obtained may be relatively greater for embodiments including microchannel condensers.

The plurality of condensers 106-112 include a condenser portion 106A, 108A, 110A, 112A and a subcooler portion 106B, 108B, 110B, 112B. The condenser portions 106A-112A can be connected to the subcooler portions 106B-112B via fluid lines or the like. In operation, the condenser portions 106A-112A can provide a liquid refrigerant to the subcooler portions 106B-112B. In this illustrated configuration, two of the condensers 106, 108 are disposed in a slanted arrangement, and two of the condensers 110, 112 are disposed vertically. It will be appreciated that the arrangement can vary, for example, depending upon a capacity of the refrigeration unit 100. For example, the vertically disposed condensers 110, 112 may not be present in an embodiment. In an embodiment, the refrigeration unit 100 may include the circuit 102A and not the circuit 102B. In such an embodiment, the vertically disposed condensers 110, 112 may not be present. It will be appreciated that these condenser arrangements are not intended to be limiting.

The circuit 102 also includes a compressor (e.g., compressor 12 in FIG. 1), an expansion device (e.g., expansion device 16 in FIG. 1), and an evaporator (e.g., evaporator 18 in FIG. 1). The refrigeration unit 100 also includes a plurality of condenser fans 114. The plurality of condenser fans 114 can be axial fans, in an embodiment. The condenser fans 114 are configured to draw a process fluid (e.g., air) across the condensers 106-112 to facilitate a heat exchange between the working fluid within the condensers 106-112 and the process fluid. In an embodiment, the condenser fans 114 can function according to generally known principles.

The circuit 102 also includes a receiver tank 116 (FIG. 3). The receiver tank 116 is fluidly connected to the condenser portions 106A-112A on an inlet side 116A of the receiver tank 116 and fluidly connected to the subcooler portions 106B-112B on an outlet side 116B of the receiver tank 116. That is, the receiver tank 116 can be disposed between the condenser portions 106A-112A and the subcooler portions 106B-112B. In an embodiment, this location can be selected to ensure that the working fluid is a saturated liquid when entering the subcooler portions 106B-112B.

In the illustrated embodiment, a single receiver tank 116 is included in the circuit 102. In an embodiment, the refrigeration unit 100 can include two receiver tanks 116—one receiver tank 116 fluidly connected to the circuit 102A and another receiver tank 116 fluidly connected to the circuit 102B. The receiver tank 116 can provide additional volume for the working fluid (e.g., refrigerant or the like). This additional volume can, for example, enable operation at a variety of operating conditions for the refrigeration unit 100. In an embodiment, including a single receiver tank 116 for the circuit 102 can, for example, reduce an amount of materials for manufacturing the refrigeration unit 100 relative to a configuration that includes a plurality of receiver tanks. In an embodiment, reducing the amount of materials can, for example, reduce a cost of the refrigeration unit 100.

In an embodiment, including a single receiver tank 116 instead of multiple receiver tanks can cause a maldistribution of the working fluid throughout the plurality of condensers 106-112. This maldistribution can, for example, lead to unpredictable operating results. To resolve this maldistribution of the working fluid, one or more of the fluid lines leaving the subcooler portions 106B-112B can include a restrictor 118.

The restrictor 118 can cause a pressure drop in the working fluid. The pressure drop can assist with properly distributing the working fluid throughout the refrigerant circuit of the circuit 102. The restrictor 118 can be a device as shown and described in FIGS. 5A-5C, according to an embodiment. In an embodiment, the restrictor 118 can be a modification in diameter of the fluid lines of the circuit 102. For example, in an embodiment a diameter of the fluid lines could be modified to induce a pressure drop. In an embodiment, a length of the fluid lines could be modified to induce a pressure drop. In an embodiment, a turn can be included in the fluid lines to induce a pressure drop. The restrictor 118 can reduce a flow of the working fluid to two of the condenser coils 106-112. In the illustrated embodiment, the condensers 108 and 112 may be restricted. By restricting the flow of the working fluid to the two condenser coils, the working fluid may be balanced among the condensers 106-112. The restrictor 118 is placed in a fluid line 126 having working fluid flowing therethrough in which the working fluid is a subcooled liquid. That is, the restrictor 118 can be placed downstream of the subcooler portions 106B-112B of the circuit 102 (e.g., in a location between an outlet of the subcooler portions 106B-112B and the expansion device 16). The placement and pressure drop selected can be based on a pressure drop resulting from the working fluid flowing through the receiver tank 116.

The particular location of the receiver tank 116 and the restrictor 118 can be, for example, based on a location at which fluid lines connecting the condensers 106-112 in parallel are merged. In FIGS. 2 and 4, fluid line 128 represents a location at which the working fluid from condensers 106, 110 is merged with the working fluid from the condensers 108, 112. The restrictor 118 can be placed in fluid line 126 at a location that is downstream of the merging of the working fluid between the condensers 106, 110 and the condensers 108, 112. In an embodiment, the fluid line 126 can represent a location for the restrictor 118 which provides a relatively greater redistribution of the working fluid, and accordingly, can provide a relatively greater advantage relative to other placements for the restrictor 118. It will be appreciated that the restrictor 118 can be placed in other fluid lines, but the redistribution effect may be relatively less than the redistribution effect when the restrictor 118 is placed in the fluid line 126. In an embodiment, a plurality of restrictors 118 can be included. In operation, the restrictor 118 can result in a uniform or substantially uniform temperature of the working fluid leaving the subcooler portions 106B-112B of the circuit 102.

Figure 5A:
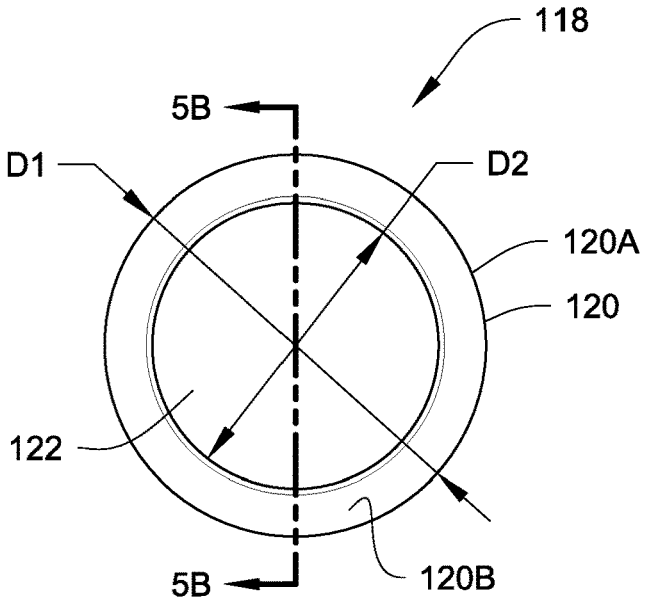
FIGS. 5A-5C show various views of an embodiment of the restrictor shown in the refrigeration unit of FIGS. 2-4.
Figure 5B:
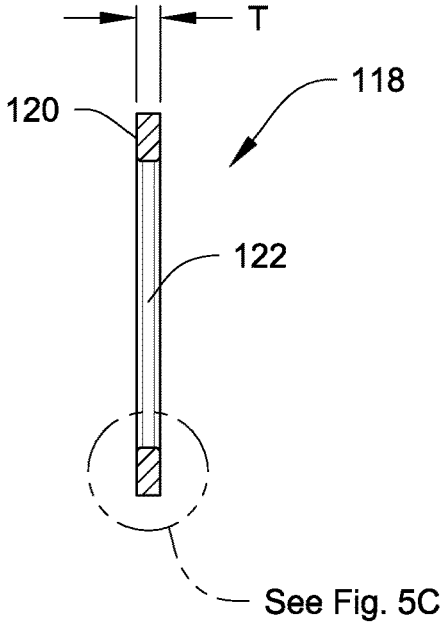
Figure 5C:
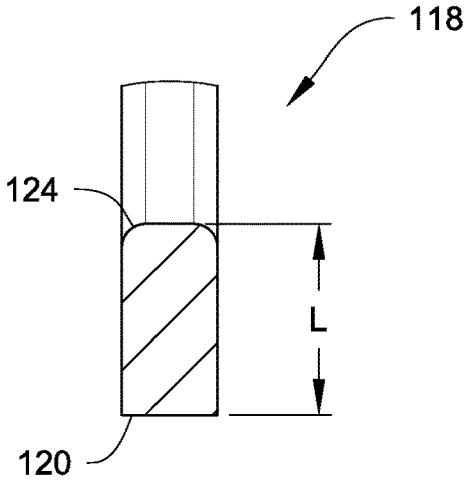

FIGS. 5A-5C show various views of an embodiment of the restrictor 118. FIG. 5A shows a front view, FIG. 5B shows a sectional view, and FIG. 5C shows a detailed partial view. The figures will be generally referred to, with some reference being made to specific figures.

In the illustrated embodiment, the restrictor 118 can alternatively be referred to as the restrictor 118. In the illustrated embodiment, the restrictor 118 includes a plate 120 having an aperture 122 therethrough. The plate 120 and the aperture 122 are substantially circular subject to, for example, manufacturing tolerances or the like. In an embodiment, an outer surface 120A of the plate 120 can be secured to an inner surface of a fluid line. In an embodiment, the plate 120 can be similar to a washer. The aperture 122 is generally smaller than a fluid line in which the restrictor 118 is placed. As a result, the plate 120 acts as an orifice and increases a pressure drop of the working fluid flowing therethrough. The plate 120 includes an outer diameter D1 and an inner diameter D2. In an embodiment, the outer diameter D1 can be selected based on a fluid line in which the restrictor 118 is placed. For example, in an embodiment, the outer diameter D1 of the restrictor 118 can be can be selected to be approaching, but less than, an inner diameter of the fluid line. In an embodiment, the inner diameter D2 can be selected to control a pressure drop of the working fluid flowing therethrough. In an embodiment, the inner diameter D2 can be from about 30 percent to about 70 percent of the outer diameter D1. In an embodiment, the inner diameter D2 can be from about 30 percent to about 60 percent of the outer diameter D1. In an embodiment, the inner diameter D2 can be from about 30 percent to about 45 percent of the outer diameter D1. It will be appreciated that these percentages are examples and can vary beyond the stated ranges.

The plate 120 can have a portion of material 120B that extends between the outer diameter D1 and the inner diameter D2. The portion of material 120B can have a length L. It will be appreciated that the length L can be defined as the outer diameter D1 minus the inner diameter D2. In an embodiment, the plate 120 can have an edge 124 of the material 120B at the aperture 122 that is slightly rounded. This can, for example, cause a smoother transition of the flow of the working fluid flowing through the aperture 122.

Figure 6:
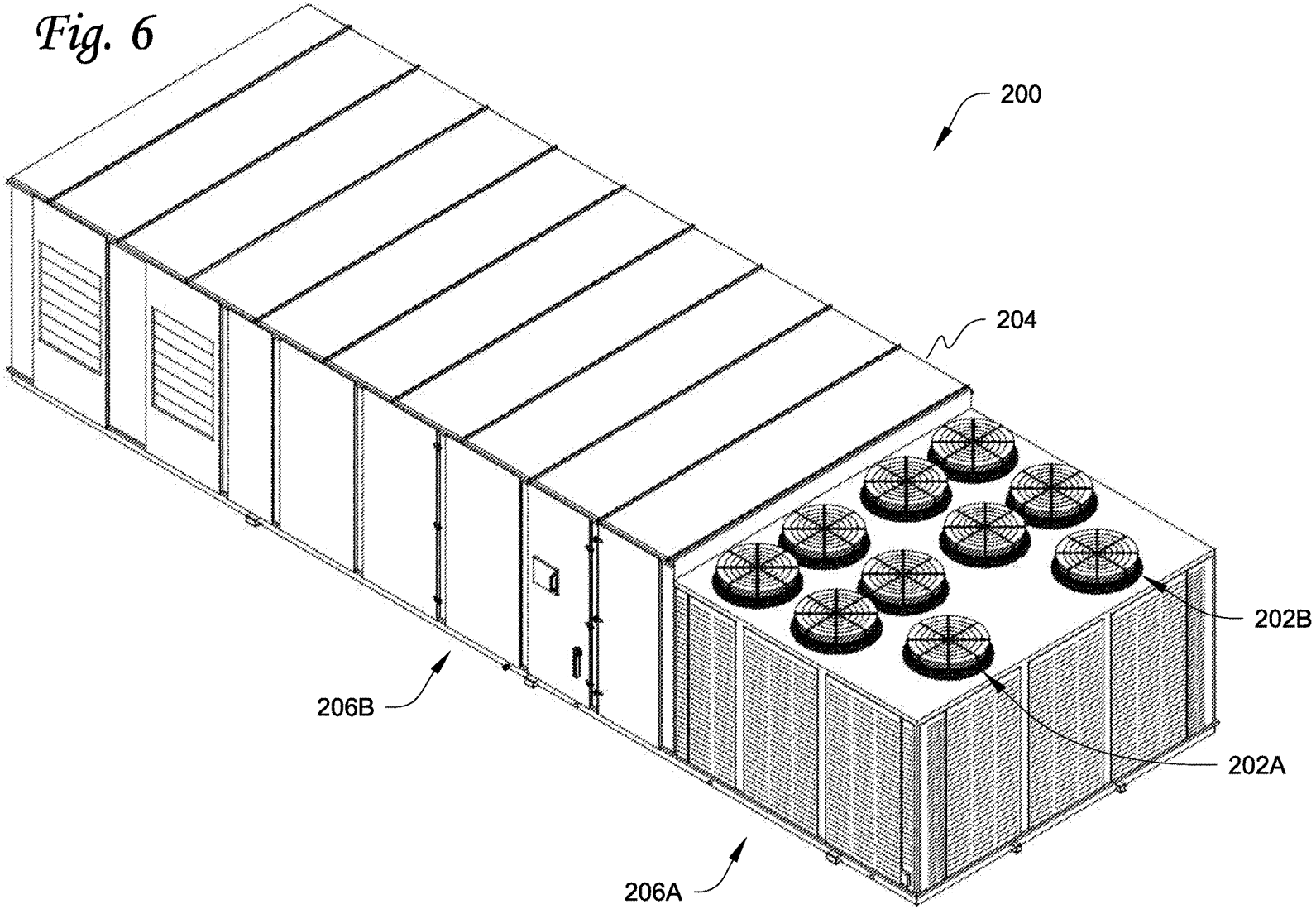
FIG. 6 is a perspective view of another refrigeration unit for an HVACR system, according to an embodiment.

FIG. 6 is a perspective view of another refrigeration unit 200 for an HVACR system, according to an embodiment. Features of FIG. 6 can be the same as or similar to features of FIGS. 2-4 described above.

The refrigeration unit 200 can, for example, be a rooftop air conditioning unit, according to an embodiment. The refrigeration unit 200 can include a refrigerant circuit such as the refrigerant circuit 10 shown and described in accordance with FIG. 1 above. In an embodiment, the refrigeration unit 200 can operate the refrigerant circuit 10 to exchange heat with a process fluid (e.g., air or the like). The process fluid can, for example, be provided to a building to control an environmental variable (e.g., temperature, humidity, or the like) in a conditioned space (e.g., one or more rooms) of the building.

In the illustrated embodiment, the refrigeration unit 200 includes a first circuit 202A and a second circuit 202B. The circuits 202A, 202B can be the same, according to an embodiment. In an embodiment, the circuits 202A, 202B can be different. It will be appreciated that the number of circuits 202A, 202B included in the refrigeration unit 200 may be determined by, for example, a capacity of the refrigeration unit 200. That is, in an embodiment, the refrigeration unit 200 may include a single circuit 202A or 202B, while another embodiment can include a plurality of refrigerant circuits 202A and 202B, or more. For simplicity of the description that follows, the circuits will generally be referred to as the circuit 202. It will be appreciated that the description is applicable to the circuit 202A and the circuit 202B.

The refrigeration unit 200 includes a condenser and compressor section 206A and an evaporator and fan section 206B. In operation, the condenser and compressor section 206A includes one or more compressors (e.g., compressor 12 in FIG. 1) and one or more condensers connected in parallel (e.g., condensers 106-112 as in FIGS. 2-4) for the circuit 202. It will be appreciated that the refrigeration unit 200 includes a single receiver (e.g., the receiver tank 116 in FIGS. 2-4) and a restrictor (e.g., the restrictor 118 in FIGS. 2-4). The circuit 202 includes a restrictor (e.g., restrictor 16 in FIG. 1) and an evaporator (e.g., evaporator 18 in FIG. 1) in the evaporator and fan section 206B. The evaporator and fan section 206B can exchange heat between the refrigerant in the circuit 202 and a gaseous process fluid (e.g., air or the like) to provide air to the conditioned space of the building.

Aspects:

Any one of aspects 1-7 can be combined with any one of aspects 8-13 or any one of aspects 14-15. Any one of aspects 8-13 can be combined with any one of aspects 14-15.

Aspect 1. A refrigeration unit for a heating, ventilation, air conditioning, and refrigeration system, comprising:

a refrigerant circuit, including:

a compressor, a condenser, an expansion device, and an evaporator fluidly connected, wherein the condenser includes a condenser portion and a subcooler portion;

a single receiver tank that is fluidly connected to an output of the condenser portion and an input of the subcooler portion; and a restrictor fluidly connected to the receiver tank, the restrictor for inducing a pressure drop in a working fluid flowing from the subcooler portion.

Aspect 2. The refrigeration unit according to aspect 1, wherein the condenser includes a plurality of condenser coils connected in parallel.

Aspect 3. The refrigeration unit according to any one of aspects 1-2, wherein the restrictor includes a restrictor plate including an aperture therethrough.

Aspect 4. The refrigeration unit according to any one of aspects 1-3, wherein the restrictor is secured to an inside of a fluid line that fluidly connects the subcooler portion and the expansion device.

Aspect 5. The refrigeration unit according to any one of aspects 1-4, wherein the restrictor receives working fluid which is a subcooled liquid.

Aspect 6. The refrigeration unit according to any one of aspects 1-5, wherein the restrictor includes a restrictor plate including an aperture therethrough.

Aspect 7. The refrigeration unit according to any one of aspects 1-6, wherein the restrictor includes a restrictor plate including an aperture therethrough, and the aperture has a diameter selected to induce the pressure drop such that the pressure drop is similar to a pressure drop induced by the receiver tank.

Aspect 8. A refrigerant circuit, comprising:

a compressor, a condenser, an expansion device, and an evaporator fluidly connected, wherein the condenser includes a condenser portion and a subcooler portion;

a single receiver tank that is fluidly connected to an output of the condenser portion and an input of the subcooler portion; and a restrictor fluidly connected to the receiver tank, the restrictor for inducing a pressure drop in a working fluid flowing from the subcooler portion.

Aspect 9. The refrigerant circuit according to aspect 8, wherein the condenser includes a plurality of condenser coils connected in parallel.

Aspect 10. The refrigerant circuit according to any one of aspects 8-9, wherein the restrictor includes a circular restrictor plate including an aperture therethrough.

Aspect 11. The refrigerant circuit according to any one of aspects 8-10, wherein the restrictor is secured to an inside of a fluid line that fluidly connects the single receiver tank, the condenser portion, and the subcooler portion.

Aspect 12. The refrigerant circuit according to any one of aspects 8-11, wherein the refrigerant circuit is included in one of a chiller and a rooftop air conditioner.

Aspect 13. The refrigerant circuit according to any one of aspects 8-12, wherein the restrictor includes a restrictor plate including an aperture therethrough, and the aperture has a diameter selected to induce the pressure drop such that the pressure drop is similar to a pressure drop induced by the receiver tank.

Aspect 14. A method, comprising:

compressing a working fluid by a compressor in a refrigerant circuit;

outputting the compressed working fluid to a condenser in the refrigerant circuit, the condenser including a condenser portion and a subcooler portion, wherein the compressed working fluid is received by the condenser portion;

condensing the working fluid in the condenser portion and outputting the condensed working fluid to a receiver tank disposed fluidly between the condenser portion and the subcooler portion; and reducing a pressure of the working fluid output from the subcooler portion after outputting the working fluid from the subcooler portion.

Aspect 15. The method of aspect 14, wherein reducing the pressure of the working fluid includes passing the working fluid through an aperture of a restrictor plate, wherein the aperture has a diameter that is less than a diameter of a fluid line in which the restrictor plate is disposed.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A refrigeration unit for a heating, ventilation, air conditioning, and refrigeration system, comprising:

a refrigerant circuit, including:

a compressor, a plurality of condensers connected in parallel and each having a condenser portion and a subcooler portion, an expansion device, and an evaporator fluidly connected;

a single receiver tank that is physically separate from and fluidly connected to an output of the condenser portion and an input of the subcooler portion of one of the plurality of condensers; and a restrictor to induce a pressure drop in a working fluid flowing from the subcooler portion of at least one of the plurality of condensers.

2. The refrigeration unit according to claim 1, wherein the restrictor includes a restrictor plate including an aperture therethrough.

3. The refrigeration unit according to claim 1, wherein the restrictor is secured to an inside of a fluid line that fluidly connects the subcooler portion and the expansion device.

4. The refrigeration unit according to claim 1, wherein the restrictor receives working fluid which is a subcooled liquid.

5. The refrigeration unit according to claim 1, wherein the restrictor includes a restrictor plate including an aperture therethrough, and the aperture has a diameter selected to induce the pressure drop, the pressure drop is based on a pressure drop induced by the receiver tank.

6. A refrigerant circuit, comprising:

a compressor, a plurality of condensers connected in parallel and each having a condenser portion and a subcooler portion, an expansion device, and an evaporator fluidly;

a single receiver tank that is physically separate from and fluidly connected to an output of the condenser portion and an input of the subcooler portion of one of the plurality of condensers; and a restrictor for inducing a pressure drop in a working fluid flowing from the subcooler portion of at least one of the plurality of condensers.

7. The refrigerant circuit according to claim 6, wherein the restrictor includes a circular restrictor plate including an aperture therethrough.

8. The refrigerant circuit according to claim 6, wherein the restrictor is secured to an inside of a fluid line that fluidly connects the subcooler portion and the expansion device.

9. The refrigerant circuit according to claim 6, wherein the restrictor includes a restrictor plate including an aperture therethrough, and the aperture has a diameter selected to induce the pressure drop, the pressure drop is based on a pressure drop induced by the receiver tank.

10. The refrigerant circuit according to claim 6, wherein the refrigerant circuit is included in one of a chiller and a rooftop air conditioner.

11. A method, comprising:

compressing a working fluid by a compressor in a refrigerant circuit;

outputting the compressed working fluid to a plurality of condensers connected in parallel and each having a condenser portion and a subcooler portion in the refrigerant circuit, wherein the compressed working fluid is received by the condenser portions of the plurality of condensers;

condensing the working fluid in the condenser portions and outputting the condensed working fluid to a single receiver tank disposed fluidly between the condenser portion and the subcooler portion of one of the plurality of condensers; and reducing a pressure of the working fluid output from the subcooler portion after outputting the working fluid from the subcooler portion.

12. The method of claim 11, wherein reducing the pressure of the working fluid includes passing the working fluid through an aperture of a restrictor plate, wherein the aperture has a diameter that is less than a diameter of a fluid line in which the restrictor plate is disposed.

* * * * *